US008480008B1

(12) United States Patent
Arnold

(10) Patent No.: US 8,480,008 B1
(45) Date of Patent: Jul. 9, 2013

(54) RAIL CONTROLLER MOUNTING APPARATUS

(76) Inventor: Jim Arnold, Grass Valley, CA (US)

( * ) Notice: Subject to any disclaimer, the term of this patent is extended or adjusted under 35 U.S.C. 154(b) by 0 days.

(21) Appl. No.: 13/373,467

(22) Filed: Nov. 15, 2011

(51) Int. Cl.
*E01B 9/00* (2006.01)

(52) U.S. Cl.
USPC ..... 238/327 R; 238/327 A; 238/338; 238/331; 238/310; 238/7

(58) Field of Classification Search
USPC ..... 238/327 R, 327 A, 338, 331, 332, 238/310, 7; 246/453
See application file for complete search history.

(56) References Cited

U.S. PATENT DOCUMENTS 948,496 A * 2/1910 Bricker ..... 238/53
1,370,537 A * 3/1921 Heumann ..... 238/10 R
1,749,857 A * 3/1930 Thomson ..... 238/155
2,664,113 A * 12/1953 Dodge ..... 139/100
3,066,869 A * 12/1962 Bishop ..... 238/9
4,635,846 A * 1/1987 Todd ..... 238/264
4,753,403 A * 6/1988 Chew ..... 246/473 R
5,150,835 A * 9/1992 Yamamoto ..... 238/50
5,285,964 A * 2/1994 Vanotti ..... 238/7
5,653,388 A * 8/1997 Pietschmann et al. ..... 238/7
6,237,856 B1 * 5/2001 Bachmann et al. ..... 238/7
7,500,617 B2 * 3/2009 Wirtz et al. ..... 238/2
7,648,080 B2 * 1/2010 Hohne et al. ..... 238/351

* cited by examiner

*Primary Examiner* — Jason C Smith
(74) *Attorney, Agent, or Firm* — Theodore J. Bielen, Jr.

(57) ABSTRACT

An apparatus for supporting a switch controller to a rail tie utilizing a frame. The frame extends along the rail tie and includes a platform which is spaced from one rail and cantilevered relative to the tie. A mount positions the switch controller to the platform and a clamp connects the frame relative to the rail tie to permit the proper positioning of the platform relative to the one rail.

12 Claims, 2 Drawing Sheets

RAIL CONTROLLER MOUNTING APPARATUS

BACKGROUND OF THE INVENTION

Railroad switches are critical components in a rail transportation system. Revised standards now require that a switch circuit controller be located at every switch point along a rail systems. Such switch circuit controller also includes a signal to the train operator denoting the status of a particular switch along the rail system.

The installation of such switch circuit controllers, in the past, has required the replacement of standard ties with ties of greater length that permits the positioning of switch circuit controller, a greater distance from a rail or rail point, concomitant with mechanical and electrical components associated with such switch circuit controllers. Unfortunately, the replacement of standard ties with longer ties is highly labor intensive and involves a substantial expense.

A support for a switch circuit controller, on a standard tie providing for the proper positioning of the same relative to a rail would be a most desirable component of a rail system adjacent a rail switch.

SUMMARY OF THE INVENTION

In accordance with the present invention a novel and useful apparatus for supporting a switch circuit controller to a rail tie of standard configuration is herein provided.

The apparatus of the present invention utilizes a frame which extends along the rail tie and lies beneath one of the rails. The frame may include a first member extending along one side of the rail tie and a second member, likewise, extending along the other side of the railroad tie. Cross-members which are linked to the first and second members of the frame extend above the rail tie on either side of the rail.

A platform is connected to the frame in a position where it is spaced from the rail and cantilevers from the end of a standard tie. The platform is sized to support the switch circuit controller and includes a mount which is intended to achieve this result. Thus, the switch circuit controller is fixed to the platform which itself is connected to the frame.

A clamp is also employed which obtains support foam, a rail and allows the positioning of the platform relative to the rail at a particular distance from the rail. The clamp is formed with a first that which is fixed to the frame. A second jaw also employed in the clamp and includes an adjustable connector for holding the first jaw relative to the second jaw. The first and second jaws each include a contact for engaging the rail. Thus, the clamp, deriving support from the rail, provides such support to the frame and platform. Thus, the switch circuit controller is located away or outboard from the rail and beyond the support afforded by a standard tie. The jaws may include recesses to serve as contacts for the rail. The adjustable connector holding the first jaw to the second jaw may take the form of an elongated member spanning the first and second jaws as well as a tightener for urging the first and second jaws together.

In many cases, a pair of identical clamps may be employed with the heretofore described frame and platform.

It may be apparent that a novel and useful apparatus for supporting a switch circuit controller has hereinabove described.

It is therefore an object of the present invention to provide an apparatus for supporting a switch circuit controller to a rail tie which allows the use of a standard rail tie as a base and provides the proper spacing of the switch circuit controller from the rail.

Another object of the present invention is to provide an apparatus for supporting a switch circuit controller to a rail tie which supports a rail that is retrofitable to standard rail ties.

Another object of the present invention is to provide an apparatus for supporting a switch circuit controller to a rail tie which may be placed at any critical switch positions along a rail line.

A further object of the present invention is to provide an apparatus for supporting a switch circuit controller to a rail tie which provides a great savings and labor and expense normally associated with removal of a standard rail tie and the reinstallation of an enlarged rail tie.

Yet another object of the present invention is to provide an apparatus for supporting a switch circuit controller to a rail tie that enhances the safety of a rail line.

Another object of the present invention is to provide an apparatus for supporting a switch circuit controller to a rail tie that is linked to a rail yet accommodates the thermal expansion and contraction of such rail.

The invention possesses other objects and advantages especially as concerns particular characteristics and features thereof which will become apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
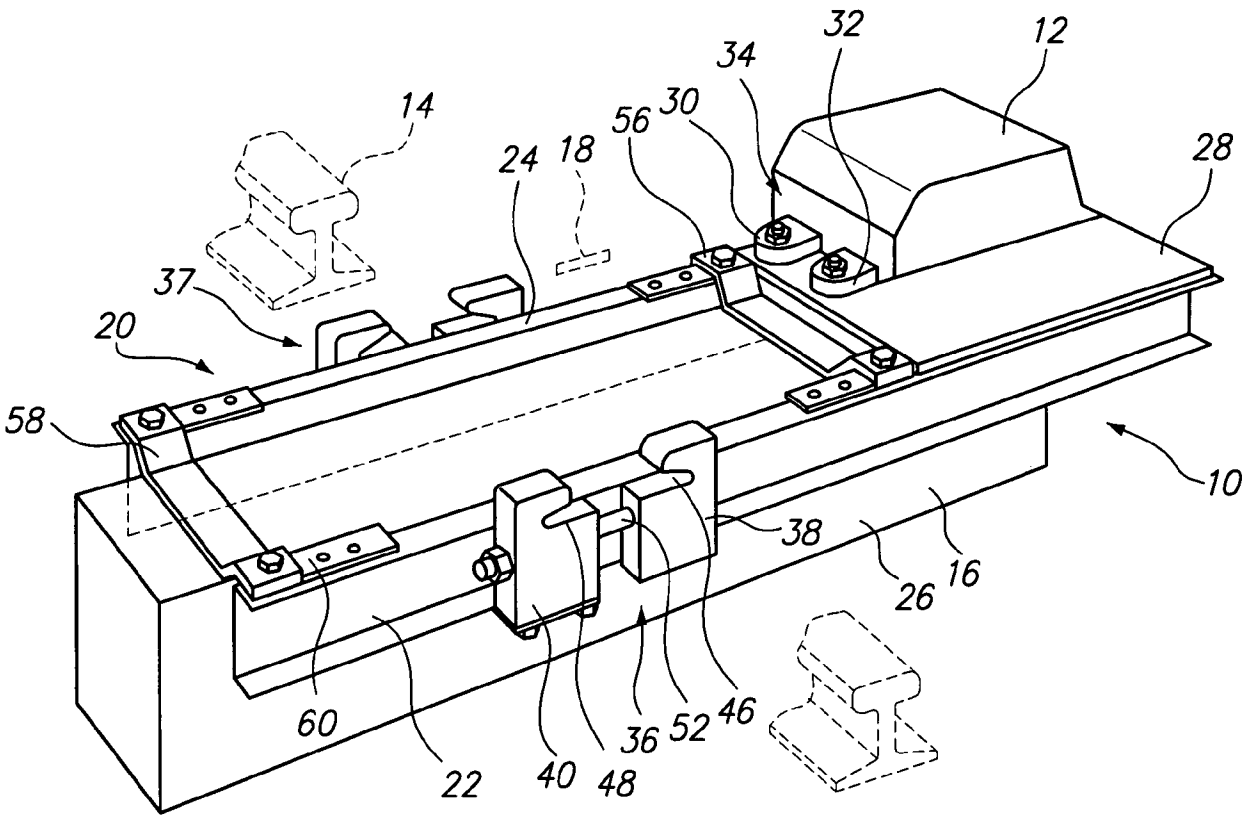
FIG. 1 is a top right side view of the apparatus of the present invention in place on a standard rail tie with a rail depicted partially and exploded from the apparatus.

An embodiment of the invention as a whole is depicted in the drawings by reference character 10, FIG. 1. Apparatus 10 is employed to support a schematically depicted switch circuit controller 12 relative to a rail 14 (shown in phantom on FIG. 1) associated with a standard railroad tie 16. Switch circuit controller 12 may be of the type model U5 manufactured by "J" manufacturing of Grass Valley Calif. Of course, other like switch circuit controllers may be used with apparatus 10 of the present invention. Switch circuit controller 12 includes various mechanical and electrical component associated with a railroad switch, including connecting rod 18 (shown partially in phantom on FIG. 1). In essence, switch circuit controller 12 must be placed a certain distance from rail 14 not permitted by standard tie 16, generally denoted as the #0 or #01 type. Tie 16 is normally composed of wood or any like material and lies atop of a railroad bed.

Apparatus 10 includes in one of its elements a frame 20. Frame 20 may be formed of any suitable material such as metal, and the like. Frame 20 is fashioned with a first elongated member 22 and a second elongated member 24. Cross-member 22 lies or extends along side 26 of tie 16. Second member 24 extends along tie 16 on the side opposite the side of 26. Platform 28 is connected to frame 20 by any suitable means such as welding, gluing, unitary formation, and the like. Platform 28 positions along frame 20 at the proper distance from rail 14 when apparatus 10 has been properly installed a relative to rail 14, which will be discussed in greater detail as the specification continues. Needless to say, platform serves as a base or mount for switch circuit controller 12. Ears 30 and 32 extending from switch circuit controller 12 and accept nuts and bolts sets 34, in the conventional manner, to fix switch circuit controller 12 to platform 28.

Figure 2:
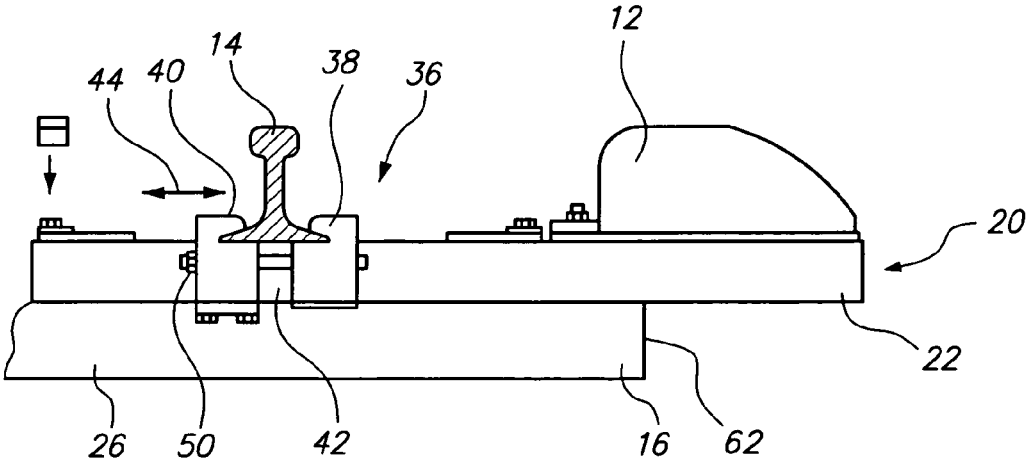
FIG. 2 is a side elevational view of the apparatus of the present invention in place on a standard rail tie with the rail shown in section.
Figure 3:
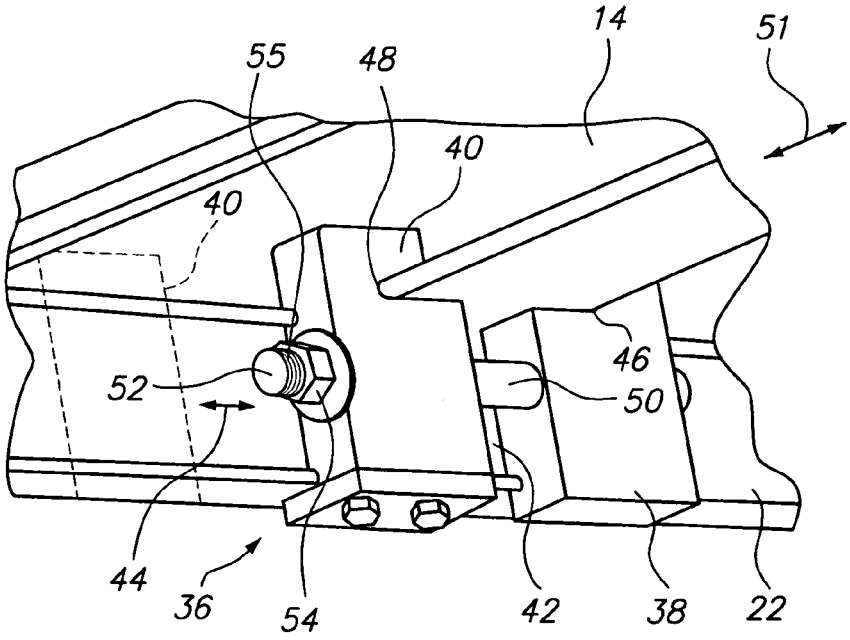
FIG. 3 is a bottom front perspective view of the clamping mechanism associated with the apparatus of the present invention.

Apparatus 10 also includes at least one clamp 36 and, preferably, a second clamp 37 of similar construction. Clamps 36 and 37 are intended to slidingly engage rail 14 to fix apparatus 10 relative to rail 14 in support of switch circuit controller 12. It should be understood that clamps 36 and 37 accommodate the thermal expansion and contraction of rail 14 ("rail running"), directional arrow 51, FIG. 3. Referring now to FIG. 2, it may be observed that clamp 36 includes a first jaw 38 and a second jaw 40. First jaw 38 is fixed to frame member 22 by welding and the like, at a place along tie 16 to properly orient switch circuit controller 12. A spacer 42 may lie between jaw 38 and first member 22 of frame 20. Second jaw 40 is moveable relative to first jaw 38 according to directional arrow 44, FIGS. 2 and 3. The separation of jaw 40 from jaw 38 prior to the actuation of clamp 36 is depicted in FIG. 3, in phantom. Recesses 46 and 48 of jaws 38 and 40 respectively, are intended to engage rail 14, depicted in FIG. 3.

An adjustable connector 50 is found in the present invention to hold first jaw 38 and second jaw 40 together, to effect the engagement of first jaw 38 and second jaw 40 to rail 14 at recesses 46 and 48 respectively, FIGS. 1 and 3. Adjustable connector 50 in the present embodiment may take the form of a partially threaded bolt 52 which is welded or otherwise fixed to jaw 38. Bolt 50 then extends through jaws 38 and 40 and is tightened by tightener nut, 54 which threadingly engages the threaded end 55 of bolt 52. Thus, jaw 40 is forced toward jaw 38 by the use of adjustable connector 50. It should be realized that clamp 37 operates and is constructed similarly to clamp 36, in this regard.

Referring again to FIG. 1, it may be apparent that angulated cross-members 56 and 58 are also found in the present invention. Cross-members 56 and 58 are underlain by supporting plates, such as exemplary supporting plate 60 along frame 20. Cross-members 56 and 58 are intended to provide extra stability to frame 20 due to the cantilevered load generated by switch circuit controller 12 on platform 20. Referring now to FIG. 2, it may be seen that switch circuit controller 12 lies outward from the end 62 of tie 16, which represents the proper operational positioning of switch circuit controller 12. Such positioning would not be possible if switch circuit controller 12 were fastened directly to tie 16.

In operation, apparatus 10 is used in conjunction with railroad tie 16 and rail 14 by fitting frame 20 along the sides of railroad tie 16, without jaw 40 being positioned on bolt 52 of adjustable connector 50. Of course, a jaw similar to jaw 40 with respect to clamp 37 would also not be in place. Recesses 46 of jaw 38 would then slidingly engage rail 14 as would a similar recess found on clamp 37. At this point, jaw 40 is passed along bolt 52 and tightened using tighten or nut 54. Clamp 37 is tightened in a similar manner employing a like jaw. Switch circuit controller 12 is then mounted to plate 28 using nut and bolt sets 34 with respect to ears 30 and 32. Of course, switch circuit controller 12 may be pre-mounted to platform 28, prior to the engagement of clamps 36 and 37 with rail 14. Cross-members 56 and 58 are then assembled, as shown in FIG. 1, to provide stability to apparatus 10 in support of switch circuit controller 12. Switch circuit controller 12 is then able to operate with respect to its electrical and mechanical components, including control rod 18, in the usual manner.

While in the foregoing, embodiments of the present invention have been set forth in considerable detail for the purposes of making a complete disclosure of the invention, it may be apparent to those of skill in the art that numerous changes, may be made in such detail without departing from the spirit and principles of the invention.

What is claimed is:

1. An apparatus for supporting a switch circuit controller to a rail tie supporting at least one rail comprising:

a. a frame, said frame extending along the rail tie beneath the one rail;

b. a platform connected to said frame, said platform being spaced from said one rail;

c. a mount positioning the switch controller to said platform;

d. a clamp, said clamp including a first jaw fixed to said frame a second jaw, and an adjustable connector for holding said first jaw to said second jaw and adjustable connector to said second jaw, said first and second jaws each further including contacts for slidingly engaging the one rail and permitting positioning of said platform relative to the one rail.

2. The apparatus of claim 1 in which each of said contacts of said first and second jaw comprises a recess.

3. The apparatus of claim 1 which additionally comprises a spacer interposed said first and second jaws and said frame.

4. The apparatus of claim 3 in which each of said contacts of said first and second jaws comprises a recess.

5. The apparatus of claim 1 in which said adjustable connector for holding said first jaw to said second jaw comprises an elongated member spanning said first and second jaws and a tightener for urging said first and second jaws together.

6. The apparatus of claim 5 in which each of said contacts of said first and second jaw comprises a recess.

7. The apparatus of claim 5 which additionally comprises a spacer interposed said first and second jaws and said frame.

8. The apparatus of claim 1 in which said frame comprises a first member extending along one side of the rail tie, and a second member extending along another side of the rail tie.

9. The apparatus of claim 8 in which additionally comprises cross-member linked to said first and second members of said frame, said cross-member extending above the rail tie.

10. The apparatus of claim 9 in which each of said contacts of said first and second jaws comprises a recess.

11. The apparatus of claim 9 which additionally comprises a spacer interposed said first and second jaws and said frame.

12. The apparatus of claim 9 in which said adjustable connector for holding said first jaw to said second jaw comprises an elongated member spanning said first and second jaws and a tightener for urging said first and second jaws together.

* * * * *